United States Patent [19]

Stetler

[11] Patent Number: 4,596,286

[45] Date of Patent: Jun. 24, 1986

[54] ROTARY PROCESSOR

[75] Inventor: Gary W. Stetler, Teller County, Colo.

[73] Assignee: Joy Manufacturing Company, Pittsburgh, Pa.

[21] Appl. No.: 658,723

[22] Filed: Oct. 9, 1984

[51] Int. Cl.[4] ..... F28F 5/04

[52] U.S. Cl. ..... 165/92; 165/163; 165/176

[58] Field of Search ..... 165/92, 163, 176; 366/147, 320, 293

[56] References Cited

U.S. PATENT DOCUMENTS

| | | | |
|---|---|---|---|
| 1,088,113 | 2/1914 | Valerius | 165/92 |
| 2,271,862 | 2/1942 | Hodgdon | 165/92 |
| 2,458,440 | 1/1949 | Stufford | 165/92 X |
| 2,890,865 | 6/1959 | Costa et al. | 165/92 |
| 3,009,683 | 11/1961 | Grieselhuber | 165/92 |
| 4,482,253 | 11/1984 | Golobic et al. | 165/87 X |

FOREIGN PATENT DOCUMENTS

| | | | |
|---|---|---|---|
| 313780 | 6/1929 | United Kingdom | 165/92 |
| 469771 | 3/1937 | United Kingdom | 165/92 |

*Primary Examiner*—Albert W. Davis, Jr.
*Assistant Examiner*—Peggy A. Neils
*Attorney, Agent, or Firm*—Edward L. Levine

[57] ABSTRACT

A rotary processor useful in mixing, conveying, and heating or cooling a fluid material. Interchangeable subassemblies each comprise a helical coil permanently affixed at each end to a terminal block. The terminal blocks of each subassembly are removably fastened at a preselected orientation to two polygonal segments of a rotatable shaft. The polygonal segments are rotated relative to one another. A portion of the shaft and the subassemblies are supported within a housing having an inlet and an outlet for flow of the material to be processed.

4 Claims, 14 Drawing Figures

ROTARY PROCESSOR

BACKGROUND OF THE INVENTION

This invention relates to rotary material processors and is generally related to processors of the screw conveyor type having conveying, mixing and heat exchange capabilities.

Material processors which function to convey, mix and act as a heat exchanger for fluid materials are well known. The term "fluid material" as used herein refers to any nongaseous material which can be made to move within or through a screw type processor, and thus includes such diverse materials as liquids, slurries and particulates.

Historically such processors have been of two main types. The first utilizes hollow helical threadlike flights permanently mounted on a rotatable central shaft which functions to support the flights and direct a heat transfer medium into and out of the flights. These units can provide excellent conveying characteristics. Exemplary of this type of processor are those described in U.S. Pat. Nos. 3,529,661 and 2,731,241. The second type utilizes a singular hollow helical tube wrapped contiguously or spaced about a central rotatable shaft. Flow of a heat transfer medium through the helical tube and commonly the shaft can provide excellent heat transfer characteristics. Exemplary of this latter type is a preheater having a spaced tube and central shaft disclosed in U.S. Pat. No. 2,639,898 and a screw type heat exchanger having a contiguous tube and shaft described in U.S. Pat. No. 3,688,837.

More recently discovered is an improved rotary material processor including a central shaft, two manifolds extending radially outwardly from the shaft, and a plurality of helical coils extending between the manifolds and parallel to the shaft. The manifolds are preferably shaped as an enlarged disc or as a central mass having a plurality of fingers extending outwardly therefrom. The manifolds extend radially from the shaft a distance larger than the farthest radial distance at which the coils extend from the shaft. This type of processor is described in detail in U.S. Pat. No. 4,482,253, issued Nov. 13, 1984; entitled Rotary Material Processor and assigned to the same assignee as the instant invention; the subject matter of said U.S. Pat. No. 4,482,253 is hereby incorporated by reference.

Each of the mentioned processor types, while useful for its intended purpose, has certain deficiencies upon which improvement can be made. The two historical processor types face complexities associated particularly with fabrication, repair and induced stresses, while the more recent processor type is somewhat complex in the preferred manner of attachment of the coils. The radial extention of the manifolds subjects the manifolds to high tip velocities and associated abrasion. The manifolds also can create pinch points for the fluid material being processed against the containing housing. It is thus desirable to provide a fluid material processor which alleviates these and other complexities and limitations.

SUMMARY OF THE INVENTION

This invention provides rotary type processors which are useful in conveying, mixing and providing a heat transfer function for fluid materials. The disclosed processors further simplify the structures and required fabrication typical of the prior art, and alleviate abrasion and pinch point concerns associated with prior manifold configurations.

In preferred form a processor includes a housing which receives and discharges the fluid material to be conveyed, mixed or otherwise processed. A shaft is contained substantially within the housing and extends outwardly to a connection with a conventional drive motor. Within the housing the shaft includes a first segment and a second segment each of which in cross section is shaped as a regular polygon having, for example, six edges. The edges of the first segment are rotated through a preselected angular rotation with respect to the edges of the second segment, and the number of edges of each segment is the same as the number of helical coils of the processor. The shaft may include hollow portions for circulation of a heat transfer fluid through the shaft and through hollow helical coils.

Removably afixed to each edge of each segment is a terminal block. Each block receives the end of a coil. The blocks are staggered along the axis of the shaft in a predetermined orientation along the segments. Each block preferably has an internal passage open to the bottom and to one face of the block. The bottom opening is aligned with an aperture in the shaft segment and the other opening receives the end of a coil. Gaskets are preferably used to seal the manifold blocks to the segments, allowing flow of a heat transfer medium between the shaft and the coil. The blocks are bolted to the segments. The coils, preferably of identical dimensions, extend between the segments and interconnect two respective terminal blocks. The coils are welded to the blocks and create a fluid tight seal. Thus, interchangeable subassemblies of a coil and two terminal blocks are formed.

The orientation and interface of the blocks and the coils is critical in order to alleviate induced stresses at the interconnection. Accordingly, the ends of the coils are straightened for a short length and the blocks are rotated, relative to the centerline of the shaft, an angular rotation equivalent to the helix angle of the corresponding coil.

A significant characteristic of the disclosed processor is that a subassembly consisting of a helical coil and two terminal blocks welded to the ends of the coil can be fabricated and readily used for field replacement; the blocks can be readily bolted to the segments under field conditions. Additionally, velocity and abrasive wear at the area of interconnection of the ends of a coil is reduced. Pinch points associated with radial manifolds are also eliminated.

BRIEF DESCRIPTION OF THE DRAWINGS

The advantages, nature and additional features of the invention will become more apparent from the following description, taken in connection with the accompanying drawings in which.

DESCRIPTION OF THE PREFERRED EMBODIMENTS

Figure 1:
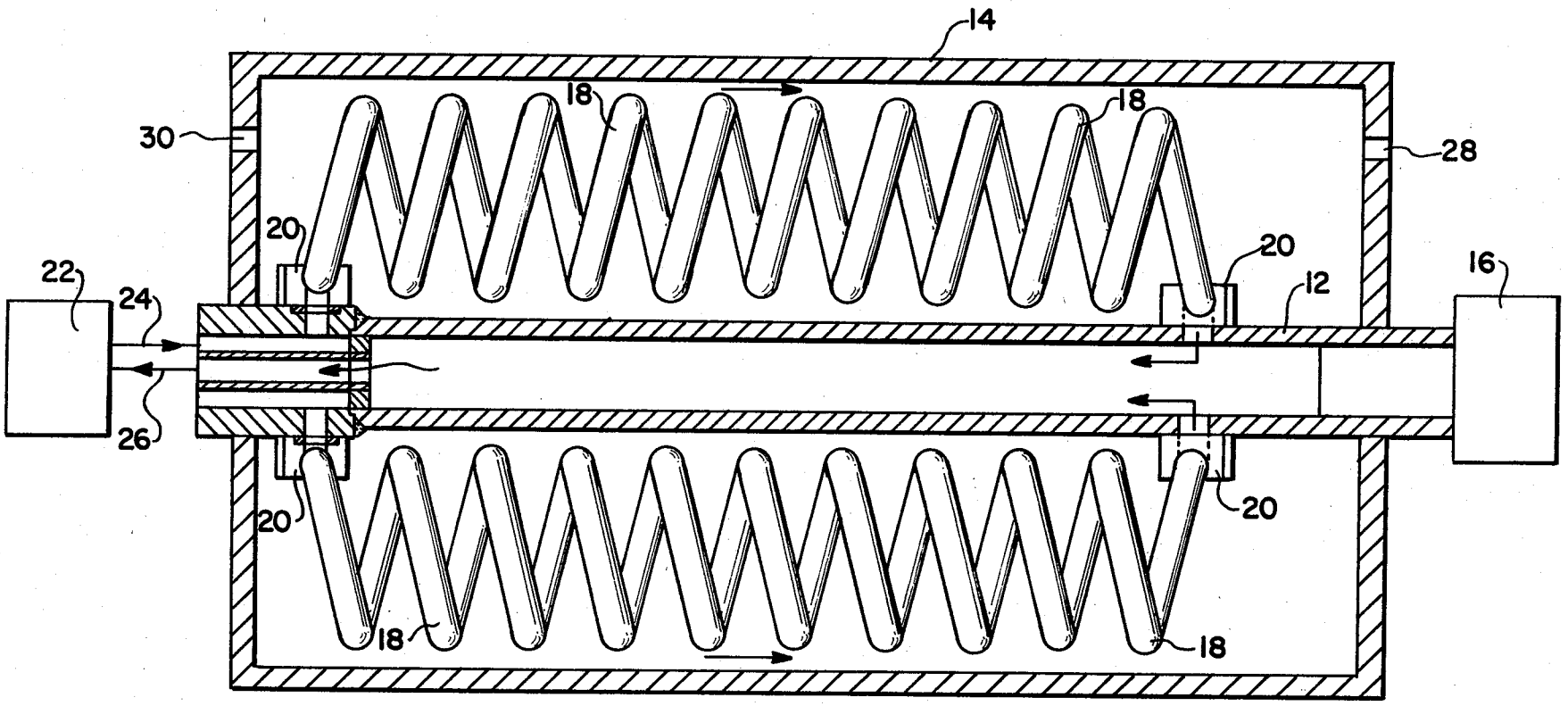
FIG. 1 is a schematic plan view of a rotary processor in accordance with the invention.

Referring now to FIG. 1 there is shown a rotary processor 10 including a shaft 12 supported by a housing 14. The shaft 12 is rotated by a drive 16. Mounted to the shaft 12 are a plurality of solid or preferably hollow helical coils 18. The coils are affixed to the shaft through terminal blocks 20 mounted at the end of each coil 18. A fluid flow path is established serially among a reservoir 22, an inlet conduit 24, the interior of the shaft 12, the coils 18, back through the shaft to an outlet conduit 26 and to the reservoir 22. The reservoir 22 preferably includes a pump and heat exchange means to cool or heat the circulated fluid. The housing 14 has an inlet 28 and an outlet 30. The inlet and outlet can be variously positioned, for example, including a top inlet and a bottom or side outlet. The drive 16 is coupled to the shaft 12 and upon rotation of the shaft 12 a fluid medium in the housing 14 is conveyed from the volume at the inlet 28 toward the volume at the outlet 30.

Figure 2:
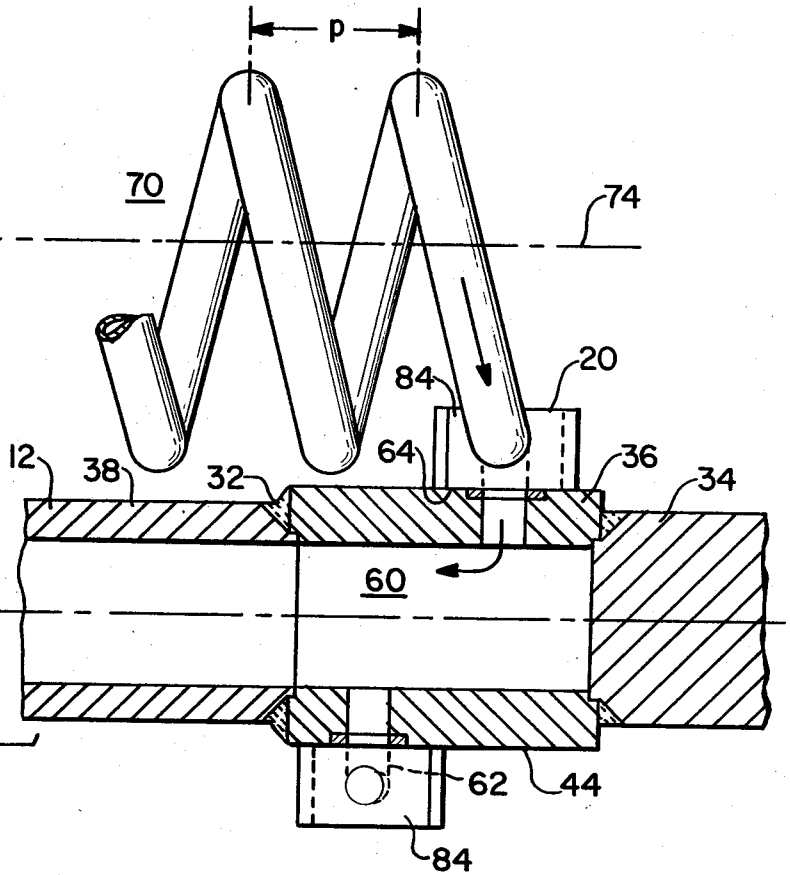
FIG. 2 is a view, partially in section, of a shaft and selected affixed components.

Additional detail of a preferred shaft 12 and selected affixed components is shown in FIG. 2. In preferred form the shaft 12 includes a plurality of segments joined to one another such as through welds 32. Included are a solid drive shaft segment 34, a first polygonal segment 36, a central segment 38, a second polygonal segment 40, and a gland shaft segment 42. The drive shaft segment 34, central segment 38 and gland shaft segment 42 are all of circular cross section, the central segment 38 and gland shaft segment 42 being of hollow tubular construction. The polygonal segments are hollow, are of polygonal exterior cross section having a plurality of edges 44, and preferably form regular polygons. A tubular guide 46 and barrier 48 are utilized at the gland segment 42 end of the shaft to direct cooling fluid flow within the shaft 12. The edges 44 of the first segment 36 are angularly offset or rotated with respect to the respective edges 44 of the second segment 40, there being six edges 44 on each segment in the exemplary processor 10.

Referring to FIGS. 2 through 5 and 6*a*, 6*b* and 6*c*, the interconnection of the terminal blocks 20 and the first 36 and second 40 segments is shown in additional detail. The number of terminal blocks 20 affixed to each segment is the same as the number of edges of that segment, as well as the same as the number of coils 18 of the processor 10. The terminal blocks 20 are removably affixed and sealed to the segments. Each block 20 includes four penetrations 50 through which removable fasteners such as bolts 52 pass. A receptacle 54 is formed in each edge 44 to receive a sealing gasket 56. The receptacles 54 can also or alternatively receive extensions 55 of the terminal blocks. Preferably the edges 44 of the polygonal segments and the bottoms of the terminal block are flat surfaces which are highly machined so that, when bolted together, a good metal to metal contact is made.

Figure 5:
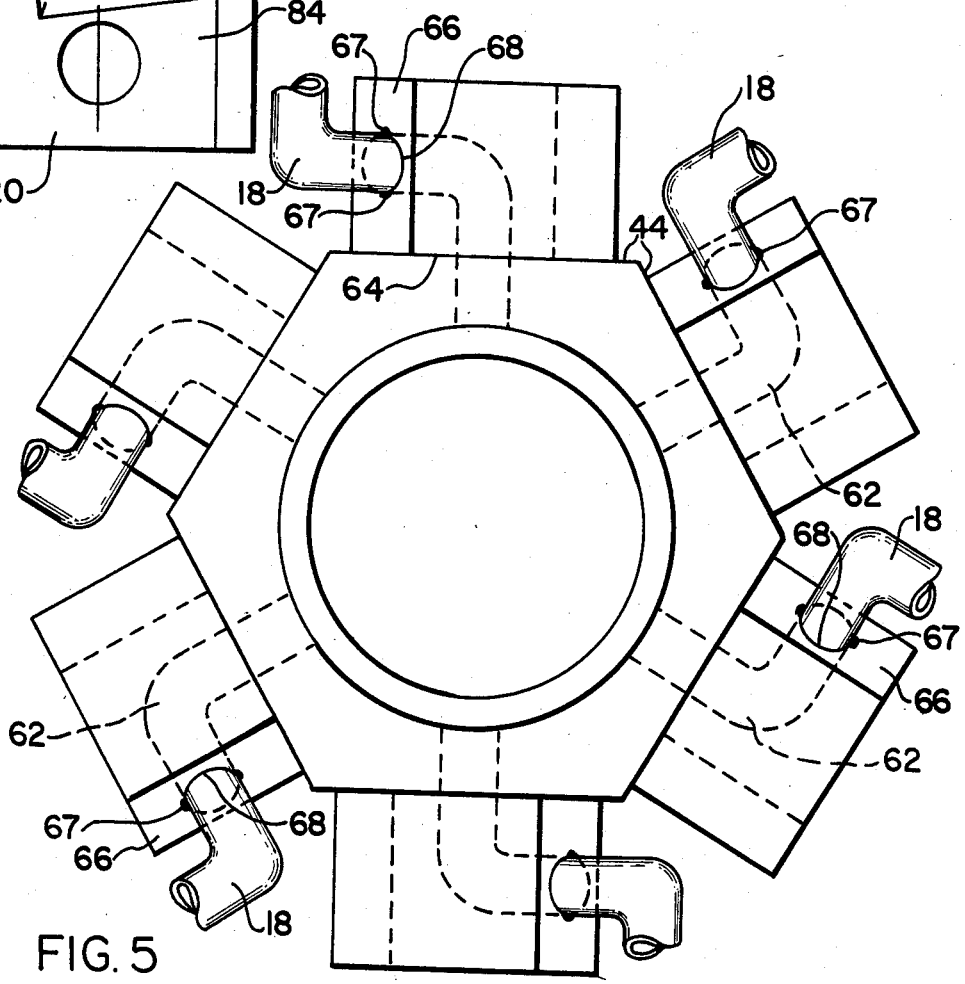
FIG. 5 is a simplified cross sectional view of terminal blocks mounted on a shaft segment.
Figure 6C:
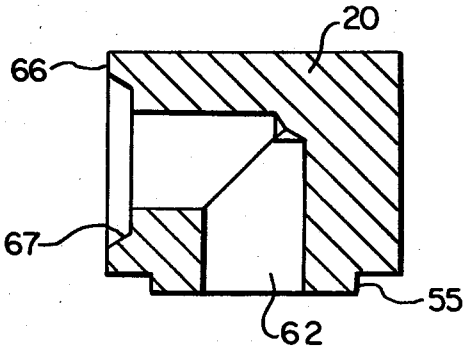
FIGS. 6*a*, 6*b* and 6*c* are respectively a bottom, front and section view of a preferred terminal block.
Figure 6B:
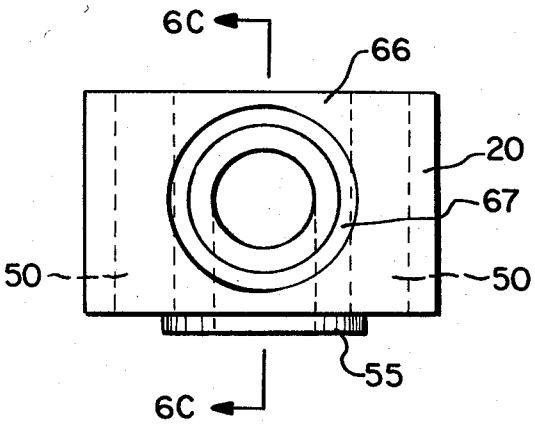
Figure 6A:
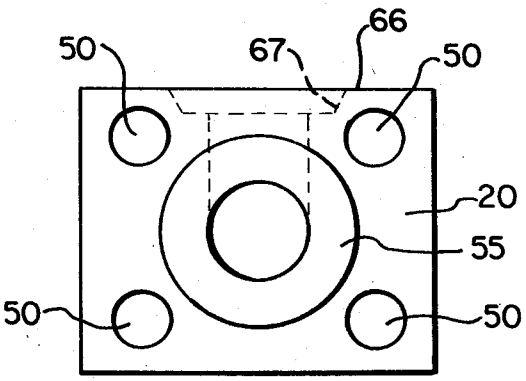

An aperture 58 extends from an interior portion 60 of each polygonal segment 36, 40 to each edge 44. The terminal blocks 20 each have a passage 62 therethrough terminating at one end at a face 66 of the block 20. The end of the passage 62 at the bottom of the block is aligned with and in direct fluid communication with a respective aperture 58. The end of the passage 62 at the face 66 of the block 20 receives an end 68 of a respective coil 18. As shown best in FIG. 6*c*, the end of the passage 62 receiving the end of the coil preferably includes an enlarged countersink 67. The ends 68 of the coils are straightened for positioning within the aperatures 58. In FIG. 5 the transition between the normal helical curve and the straightened ends 68 is highly exaggerated. The coils 18 are welded to the terminal blocks 20 as shown at numeral 67 of FIG. 5.

Figure 7A:
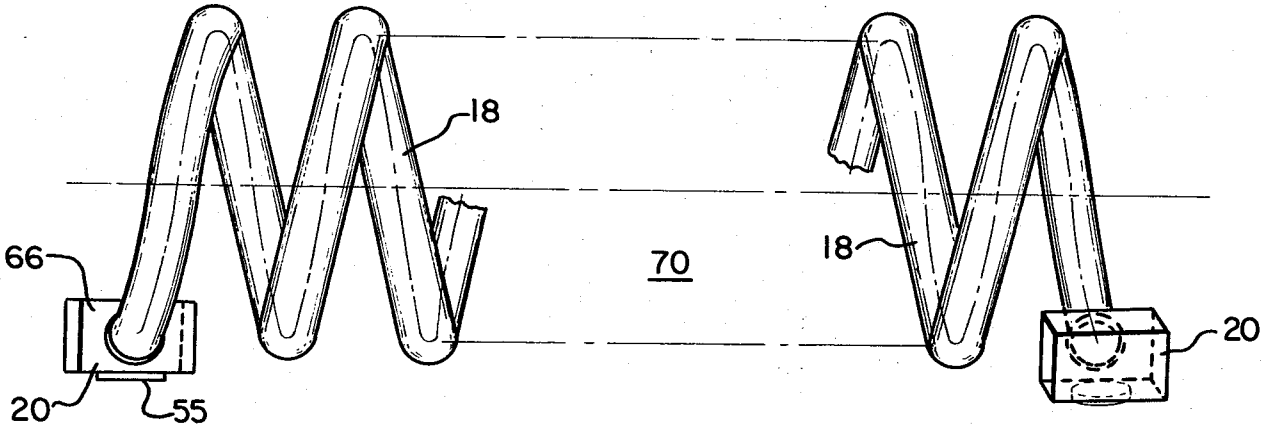
FIGS. 7*a*, 7*b* and 7*c* are respectively a side, top and end view of a terminal block and coil subassembly.
Figure 7C:
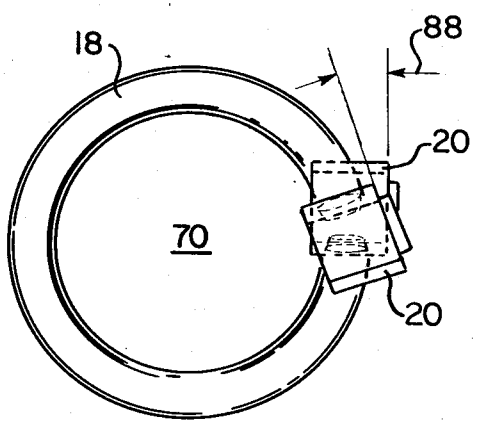
Figure 7B:
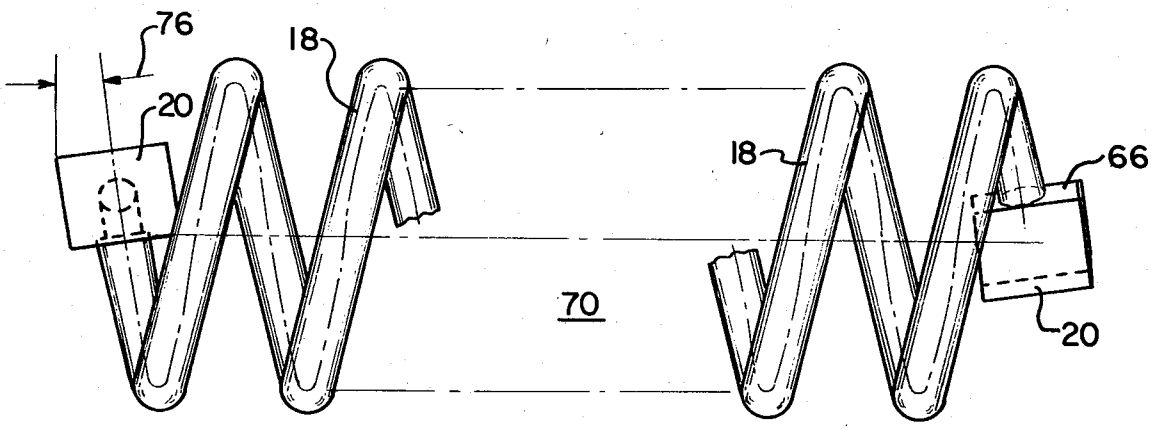

During fabrication subassemblies 70, FIGS. 7*a*, 7*b*, 7*c*, are formed comprising a coil 18 and the terminal blocks 20 welded to the ends 68 of the coil. For field modification, repair, or initial assembly, the terminal blocks 20 can readily be bolted and secured to the polygonal segments 36, 40. The exemplary processor has six subassemblies 70.

Figure 8C:
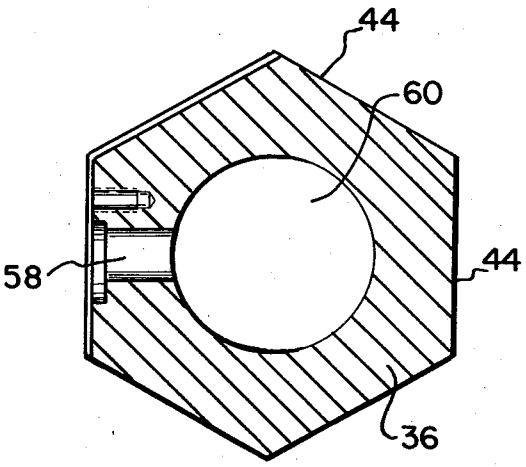
FIGS. 8*a*, 8*b* and 8*c* are respectively a front, end, and section view of a shaft segment, FIG. 8*c* being a section taken at 8C—8C of FIG. 8*a*.
Figure 8A:
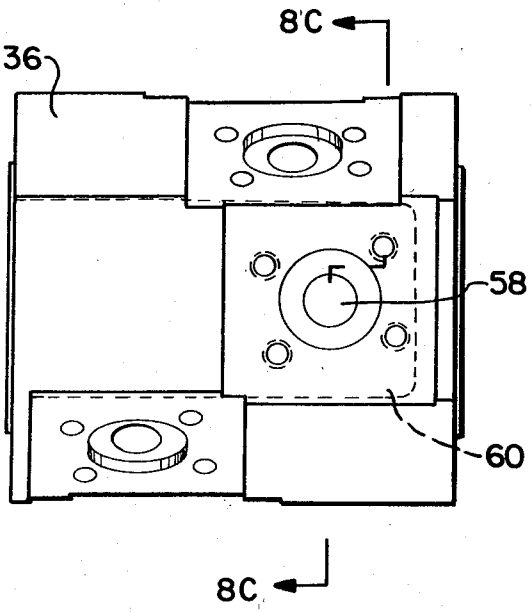
Figure 8B:
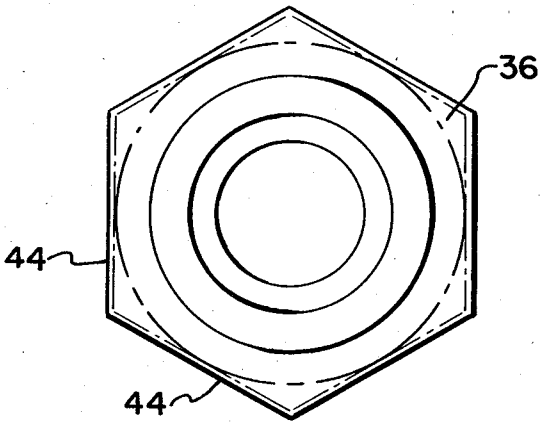

Each of the coils 18, and also the subassemblies 70 are preferably identical and hence interchangeable. However, the terminal blocks 20 are staggered along the polygonal segments as shown best in FIG. 4 where the centerline c through a circular end of the passage 62 at the face 66 of a block is spaced a distance d from the equivalent centerline of the next consecutive block 20. This axial staggering is also shown i FIG. 8*a*. This staggering or spacing along the axial length of the shaft 12 provides better accessibility for fabrication and repair. The preferred staggering distance d between blocks of consecutive subassemblies 70 is equal to the pitch p of the helical coils divided by the number of subassemblies 70. This spacing provides good conveyance characteristics and, particularly for subassemblies with inherently small clearances, allows nesting among consecutive coils.

The height of the terminal blocks 20 and the spacing from the shaft of the end of the passage 62 which receives the coil 18 is such that the coils are maintained a preselected distance from the shaft. The coil enters the terminal block at the low point of its helix, that is, the point closest to the shaft. For shorter processors the coils can be supported merely at the ends. The processor can also include clamps along the central segment 38 for additional support of the coils. The exterior of the polygonal sections, for example the across flats dimension of a regular polygon, is larger than the diameter of the central segment to provide spacing between the coils and the shaft. The spacing can be established to minimize the potential for buildup of the material being processed between the coils and the shaft.

Figure 3:
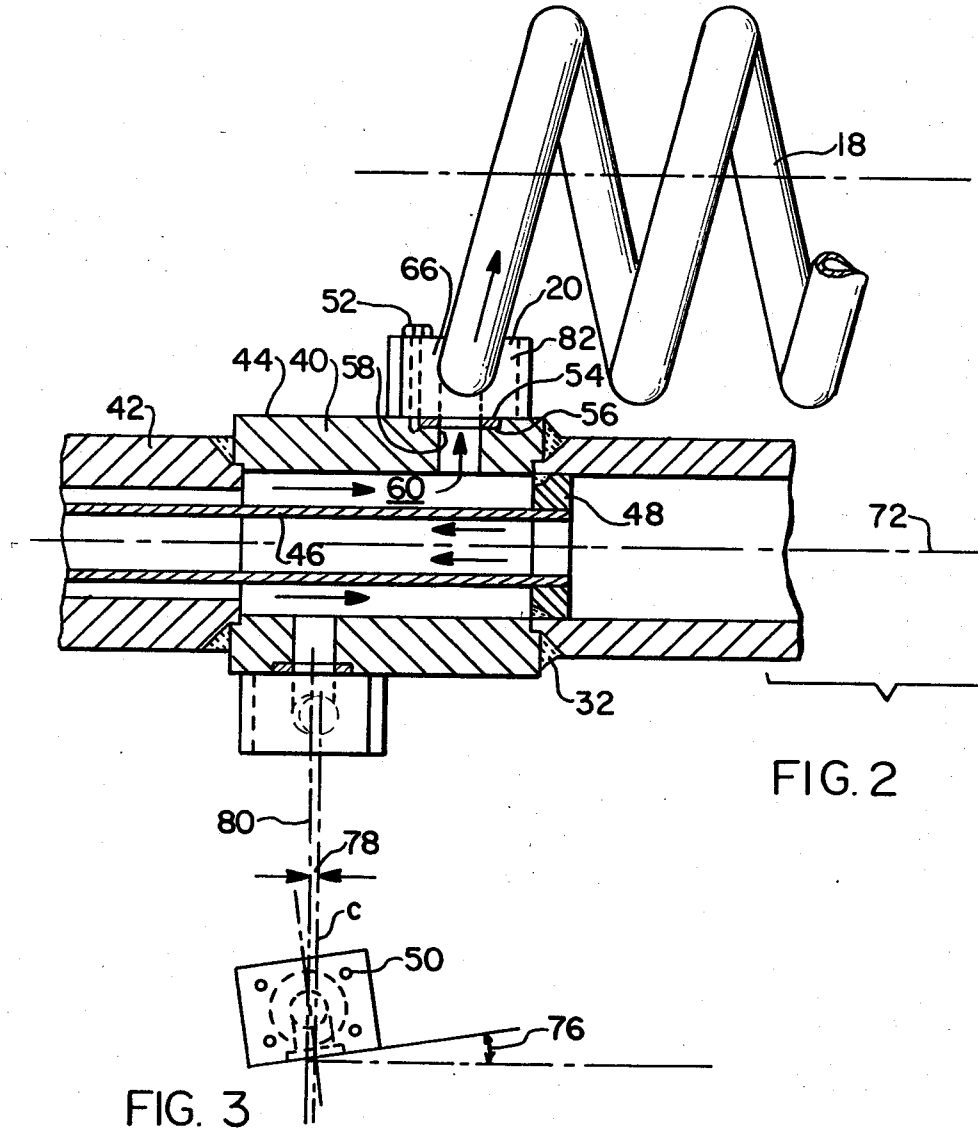
FIG. 3 is a top view of a terminal block additionally showing an angular orientation of the block relative to the shaft axial centerline.
Figure 4:
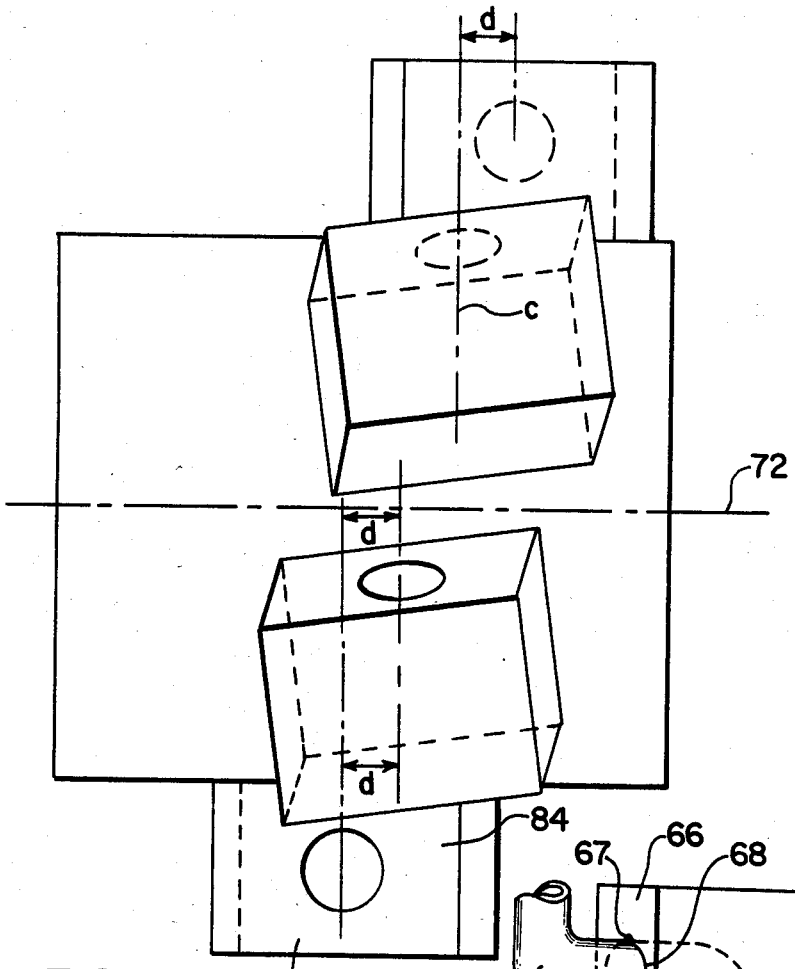
FIG. 4 is a simplified perspective view of staggered terminal blocks mounted on a shaft segment.

As shown particularly in FIGS. 2, 3 and 4 the side face 66 of a rectangular terminal block 20 receiving the end of the respective coil is rotated slightly with respect to the axis 72 of the shaft and the parallel axis 74 of the coil. The rotated relation is also apparent in FIGS. 7*a*, 7*b* and 7*c*. With this orientation the coil enters the block at a right angle to the face 66. The rotated configuration is critical toward alleviating stresses induced in the coil during fabrication and operation and to ensure a solid weld between the block and coil. The angle of rotation 76 is equal to the helix angle and will for most processors vary between approximately 8 degrees and 22 degrees, preferably being approximately eight degrees. The helix angle is defined by the relationship cotan $\alpha$ (helix angle)=pitch/(mean diameter of helical coil) where the pitch is the angular degree of the pitch of the helical coil and the mean diameter of the helical coil is the circumferential dimension of the center of the circle formed by outside diameter of the coil minus the thickness of the coil.

The rotated configuration causes an offset 78 (FIG. 2) between a centerline 80 of the aperture 58 through the polygonal segment and the centerline of the end of the passage 62 of the terminal block 20 receiving the coil 18. It is critical that the offset 78 be accounted for in the initial design and sizing of a given processor since the coils 18 enter a front face 82 of one terminal block 20 and enter a rear face 84 of the other respective terminal block 20. The actual length of the coil 18 between the blocks 20 is equal to the distance between respective apertures 58 minus twice the offset distance 78. Although the offset distance is relatively small, being approximately two-tenths of an inch in an exemplary processor having coils 18 of an outside diameter of eleven inches, incorporation of the distance is critical in order to minimize induced stresses. In an exemplary processor the straightened ends of the coils 18 extend into the respective terminal blocks 20 approximately one-quarter inch. The helix angle 76 is $8°34' \pm 30'$.

As noted above, the faces of the two polygonal shaft segments are not parallel, but are rotated with respect to one another. This rotation is accordingly accounted for in fabrication of each subassembly 70 to minimize stresses. The rotational angle, shown at reference numeral 88 in FIG. *7c*, is 14° - 6′ in the exemplary processor. This angular offset is preferably between ten (10) and eighteen (18) degrees. This angle is determined among several considerations and is the manner by which the helical coil is made most closely to align at ninety degrees to the manifold block. If the terminal block were infinitely thin along a line between the center of the polygonal section and the axis of the corresponding coil, the coil would approach that infinitely thin line at ninety degrees. However, because the terminal block has thickness, the approach angle is other than ninety degrees. The rotation of the polygonal segments accounts for this angular difference. Close consideration will also note that this ninety degree approach relationship can also be achieved by moving the block "back and away" from the approach of the coil. However, the amount of area available to move the block is limited by the size of the corresponding edge 44. A combination of these considerations can also be used.

It will now be apparent that the disclosed processor provides advantages with respect to prior units. Subassemblies can readily be replaced in the field without need for cutting or making welds. Fabrication of a processor is simplified since fabrication and machining associated with extended manifolds is eliminated. Elimination of the extended manifolds also lessens concerns about a pinch point buildup of material between the outer surfaces of the extended manifold and the containing housing. The subassemblies of two terminal blocks and a coil can easily be manufactured to close tolerance levels through use of a simple jig. Abrasive wear of processor components and particularly the area of attachment of the ends of the coils is reduced since this area has been moved toward the center of the shaft and hence moves with a lower tip speed than if mounted at the ends of an extended manifold.

Many alternative configurations are readily apparent within the scope of the disclosed invention. For example, while the shaft has been shown and discussed as including five separate sections, various sections can be combined. The central and polygonal segments can be one piece. While it is preferred that the subassemblies be identical, coils of differing configuration in a single processor can be used. The exterior configuration of the terminal blocks can be modified to eliminate sharp corners and provide a more streamlined construction even less subject to abrasive wear. Other modifications are possible. It is therefore intended that the written specification and drawings be interpreted as illustrative, and not in a limiting sense.

I claim:

1. A fluid material rotary processor comprising:

a plurality of interchangeable subassemblies, each said subassembly including two terminal blocks and a helical coil having two ends, each of said ends being sealingly and permanently affixed within one of said terminal blocks, each said coil having a coil axis;

a shaft including a shaft axis, a first segment and a second segment, said segments each having exterior edges forming in cross section a polygon, said edges of said first segment being angularly offset with respect to said edges of said second segment, said axes of said coils being parallel to said shaft axis;

means for removably mounting said subassemblies to said edges of said segments such that said coils are mounted aside said shaft and certain of said subassemblies are axially staggered along said shaft with respect to other of said subassemblies;

a housing having a fluid material inlet and outlet; means for supporting and rotating said segments and affixed subassemblies within said housing;

said coils entering said terminal blocks at an entry angle with respect to said shaft axis, said entry angle being equivalent to the helix angle of said respective coil, and said certain subassemblies being staggered along said shaft with respect to other of said subassemblies by a distance equivalent to the pitch of said coils divided by the number of said subassemblies.

2. The processor of claim 1 wherein said shaft includes a hollow portion and a solid drive portion of circular cross section, said coils are hollow, said terminal blocks have a passage therethrough and said segments have apertures aligned with respective passages, and further comprising means for flowing a heat transfer fluid from a reservoir serially through said shaft, aperture, passage, coil, another passage, another aperture, and said shaft back to said reservoir, the mating edges of said segments and bottom surfaces of said terminal blocks being compatibly machined and further comprising a sealing gasket positioned between each respective machined mating edge and bottom surface.

3. The processor of claim 2 wherein said edges form in cross section a regular polygon having the same number of sides as the number of said subassemblies and wherein said coils are welded to said terminal blocks and said terminal blocks are bolted to said segments.

4. The processor of claim 1 and wherein each said coil is interconnected to said respective terminal blocks and segments at a position along said helical coil closest to said shaft.

* * * * *